US006725948B2

(12) United States Patent
Koch

(10) Patent No.: US 6,725,948 B2
(45) Date of Patent: Apr. 27, 2004

(54) METHOD OF REGULATING THE FEED FORCE OF A DRILLING DEVICE

(75) Inventor: Elmar Koch, Eslohe (DE)

(73) Assignee: Tracto-Technik GmbH (DE)

( * ) Notice: Subject to any disclaimer, the term of this patent is extended or adjusted under 35 U.S.C. 154(b) by 0 days.

(21) Appl. No.: 10/263,010

(22) Filed: Oct. 2, 2002

(65) Prior Publication Data

US 2003/0111265 A1 Jun. 19, 2003

(30) Foreign Application Priority Data

Oct. 4, 2001 (DE) ..... 101 49 018

(51) Int. Cl.[7] ..... E21B 44/02; E21B 7/06; E21B 7/10

(52) U.S. Cl. ..... 175/61; 175/27; 175/26; 173/177; 173/5

(58) Field of Search ..... 175/61, 26, 27, 175/45; 173/4, 5, 8, 9, 11, 177

(56) References Cited

U.S. PATENT DOCUMENTS

| | | | | |
|---|---|---|---|---|
| 3,610,343 A | * | 10/1971 | Bratt | 173/177 |
| 3,905,427 A | * | 9/1975 | Kenney | 173/177 |
| 4,064,950 A | * | 12/1977 | Salmi et al. | 173/151 |
| 4,858,705 A | | 8/1989 | Thiery | |
| 5,449,046 A | * | 9/1995 | Kinnan | 175/24 |
| 5,454,436 A | * | 10/1995 | Jardine et al. | 175/40 |
| 5,913,371 A | * | 6/1999 | Jenne | 175/27 |
| 6,019,180 A | * | 2/2000 | Pafitis et al. | 175/38 |
| 6,109,367 A | * | 8/2000 | Bischel et al. | 175/24 |
| 6,173,796 B1 | * | 1/2001 | McLeod | 175/257 |

FOREIGN PATENT DOCUMENTS

| | | |
|---|---|---|
| DE | 199 47 645 C1 | 3/2001 |
| GB | 1 463 096 | 2/1977 |
| GB | 2 370 056 A | 6/2002 |
| GB | 0222832.8 | 12/2002 |

OTHER PUBLICATIONS

Chevron Chemical Company, Technical Note: Horizontal Directional Drilling (Guided Boring) with PLEXCO Pipe, Mar. 2000, Trenchless Technology Bulletin No. 1.*

Prikel, Gottfried, "Deep Well Drilling Technology," 1959, pp. 51–52, Published by Springer–Verlag, Vienna, Austria.

* cited by examiner

*Primary Examiner*—David Bagnell
*Assistant Examiner*—Shane Phun Bomar
(74) *Attorney, Agent, or Firm*—Cook, Alex, McFarron, Manzo, Cummings & Mehler, Ltd.

(57) ABSTRACT

In a method of regulating the feed force of a drilling device having a hydrostatic bore hole motor at the end of a linkage provided with a rotary and a feed drive, the feed of the linkage is set as a function of the pressure of the drive fluid for the bore hole motor in such a way that the liquid pressure remains in a predefined range or else remains constant. If the bore hole motor is equipped with an eccentricity for directional boring, for example with an angled housing, then, in addition or else independently of the feed control, directional deviations normally resulting from the linkage torsion can be compensated for by the eccentricity or the linkage being set to a corrected path angle.

5 Claims, 2 Drawing Sheets

METHOD OF REGULATING THE FEED FORCE OF A DRILLING DEVICE

This application claims priority from German Patent Application No. 101 49 018.6-24 filed on Oct. 4, 2001, which is incorporated by reference herein.

The invention relates to a method of regulating or controlling the feed force of a drilling device whose linkage is provided with a hydrostatic bore hole motor which may have an eccentricity.

Bore hole motors of this type are also known under the designation mud motor and comprise a housing with an external diameter which corresponds approximately to the linkage diameter. U.S. Pat. No. 6,173,796 describes such a bore hole motor. Its housing, which serves as a stator, has a thread on the inside and contains a rotor likewise having a thread whose number of turns is one turn less than the number of turns on the stator. The rotor is connected to the drive shaft of a tool and, for the purpose of directional boring, can have an eccentricity, for example one or more kinks.

Bore hole motors, for example water or mud motors, operate on the principle of displacing screw motors and are driven with the aid of a fluid supplied via the drilling linkage, for example a water-bentonite suspension (drive fluid).

If the bore hole motor (MUD motor) or the linkage is provided with an eccentricity, the linkage has to rotate during rectilinear boring in order to neutralize the eccentricity, for example a kinked motor housing. During curved boring, on the other hand, the linkage rotation is interrupted, the eccentricity is brought into the angular position (path angle) which is decisive for the predefined curved path, and the non-rotating linkage with the tool driven by the bore hole motor is forced into the earth or rock by the feed drive. Here, the problem arises that the rotating extraction tool exerts a torque on the linkage which has the effect of linkage torsion. This linkage torsion then leads to a more or less significant deviation from the angular position set on the linkage drive. In order to correct this deviation, first of all a measurement is required, in order to determine the actual position of the tool or of the eccentricity, and to set the angular position to a corrected value. This requires the bore hole motor to be stopped in order to avoid vibrations which distort the measured result, and a great deal of skill on the part of the operating personnel. In addition, there is no torsion when the borehole motor is stopped. The machine operator determines the deviation only after a specific boring length has been covered, and then has to correct the boring direction or the boring angle. This is time-consuming and leads to a "meandering" course of the bore, which leads to increased casing friction when a product pipe is pulled in.

Since the tool merely provides the extraction work, the linkage is connected to a feed drive which moves the linkage forward with a specific feed force. This feed force is normally set by hand in order to take account of different ground conditions. In the event of too low a feed force, for example in soft ground, the feed speed is too low and boring is uneconomic. In the event of too high a feed force, for example in rocky subsoil, it is by contrast possible for the bore hole motor to stop in the ground or in the rock. The drive fluid which continues to be supplied then emerges at high speed between rotor and stator into the surroundings of the drilling head and—in particular when a liquid/solid suspension is used as the drive fluid—leads to severe wear on the stator thread and on the rotor thread.

If the bore hole motor or the linkage is provided with an eccentricity for directional boring, according to the invention, directional accuracy can be improved by the eccentricity not being set to the desired direction but to an angle of attack $\gamma$ which compensates for the linkage torsion.

If $\alpha$ is the path angle which is required for the desired boring direction or curved path and to which the eccentricity is normally set with the linkage at rest, then the angle of attack is given by the following equation:

$$\gamma=\alpha-\beta.$$

Here, $\beta$ corresponds to the torsion compensation angle which necessarily results during boring. This is calculated in accordance with the following formula:

$$\beta=\frac{T\cdot 1}{Ip\cdot G}\cdot\frac{180^{\circ}}{\pi}+K_1\cdot 1,$$

in which

T=torque of the bore hole motor using the motor characteristic curve as a function of the pressure of the drive fluid (bentonite suspension)

l=drilling string length $I_p$=polar surface moment of 2nd order

G=shear modulus of linkage material $K_1$=correction factor for changing pipe cross-sections in the connecting area.

With the aid of this formula, it is possible, in spite of the continuously changing length of the drilling linkage (number of linkage sections), to compensate for the linkage torsion, so that the eccentricity that determines the actual path of the tool through the ground or a rocky subsoil exactly follows the planned run. Monitoring measurements and the continual readjustment, on the basis of these measurements, of the linkage, which does not rotate during curved boring, are not required in the method according to the invention; the result is fewer erroneous bores even in the case of unpracticed operating personnel, and a higher boring speed, since the expenditure on time for the monitoring measurements and the readjustment of the linkage in order to correct the boring direction as a result of the unavoidable torsion are dispensed with.

In order to avoid undesired stoppage of the bore hole motor, the invention proposes to regulate the feed force of the linkage as a function of the pressure of the drive fluid, for example a bentonite/water suspension, for the bore hole motor. This can be done by the liquid pressure—as close as possible to the pressure leading to a motor stoppage—remaining in a predefined tolerance range or else being kept substantially constant. The characteristic curve of the bore hole motor reveals the fluid pressure at which the motor stops. Taking account of the volume-flow-dependent pressure losses in the linkage, according to the invention it is possible to determine that pressure at a point outside the ground, for example in the area of the drive, at which there is a risk of a motor stoppage. The feed force of the linkage is regulated according to the invention in such a way that the fluid pressure at the bore hole motor does not reach this pressure, but also does not deviate too extensively from this, in order to be able to operate with the highest possible feed rate, that is to say optimally.

The feed force of the linkage is preferably regulated as a function of the pressure of the drive fluid for the bore hole motor in accordance with the formula $$p_M=p_p-\Delta p_G\cdot n-\Delta p_M,$$

in which $p_M$=pressure of the bentonite/water suspension at the bore hole motor $p_P$=pressure of the bentonite/water suspension at the high pressure pump $\Delta p_G$=pressure drop per linkage section n=number of linkage sections $\Delta p_M$=pressure drop through machine, etc.

in such a way that the torque of the bore hole motor remains slightly, for example 2 to 5%, below the blocking torque. In this case, the blocking torque is to be understood to be that torque effective at the bore hole motor or tool at which the bore hole motor stops.

The combination of the torsion compensation according to the invention with the feed control according to the invention is particularly advantageous. Even during directed boring, this combination ensures a course of the bore which is suitable for the run, with an optimally driven drilling tool.

BRIEF DESCRIPTION OF THE DRAWINGS

The invention will be explained in more detail below using an exemplary embodiment which is illustrated in the drawing, in which.

DESCRIPTION OF THE ILLUSTRATED EMBODIMENT

Figure 1:
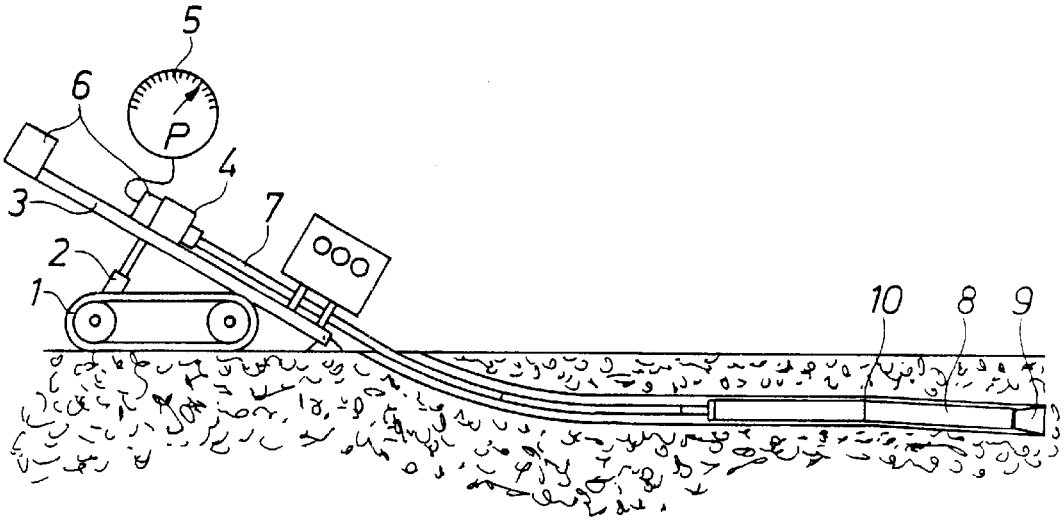
FIG. 1 shows a drilling device according to the invention in a schematic illustration.

The drilling device according to the invention comprises a chassis 1, on which a mounting 3 is mounted such that it can be pivoted with the aid of a hydraulic cylinder 2. The mounting 3 is provided with a carriage 4, on which a pressure indicating device 5 or measuring instrument for the control and also a rotary and feed drive 6 for a linkage 7 of individual pipe sections is arranged. At the front, the linkage is provided with a bore hole motor 8 (MUD motor) as a drive for an extraction tool 9. The housing of the bore hole motor 8 has a bending point 10 which, when the linkage 7 is not rotating, permits curved boring. When the linkage is rotating, on the other hand, the bending point 10 is neutralized and, accordingly, rectilinear boring takes place.

Figure 2:
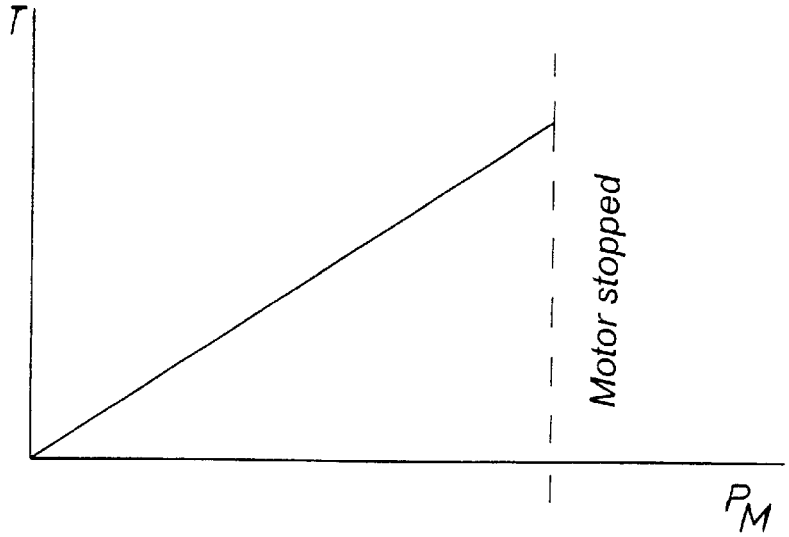
FIG. 2 shows a graph with the dependence of the torque of the bore hole motor as a function of the pressure of the drive fluid at the bore hole motor.

The graph of FIG. 2 shows the motor characteristic curve, that is to say the dependence of the torque T effective on the bore hole motor or tool on the pressure $p_M$ of the drive fluid (bentonite/water suspension) on the bore hole motor.

Figure 3:
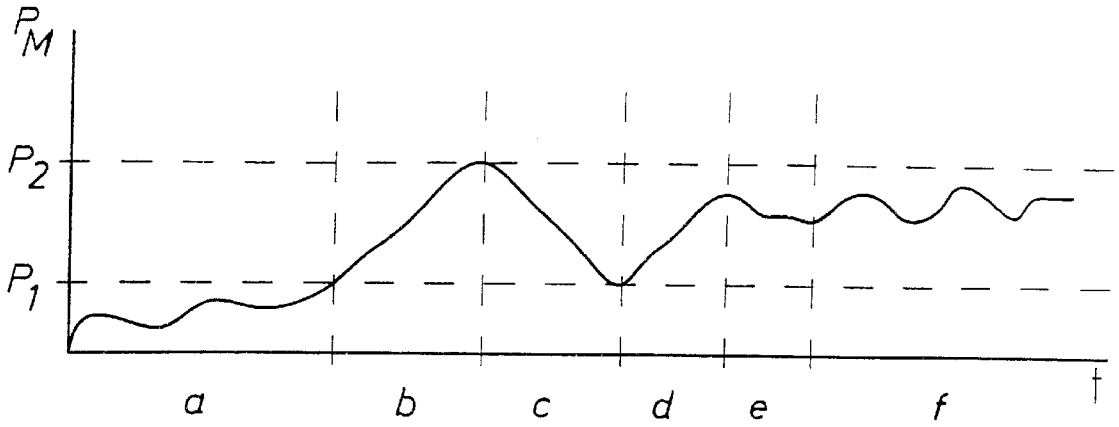
FIG. 3 shows a pressure/time graph for the bore hole motor.

In the graph of FIG. 3, the y-axis illustrates the fluid pressure $p_M$ on the bore hole motor and the x-axis illustrates the time t with a plurality of boring phases a to f. The optimum operating range of the bore hole motor 8 corresponds to the fluid pressure $P_2$. In the initial boring phase a, the fluid pressure is still below the lower limiting value $P_1$. Only when the boring resistance increases does the fluid pressure in the boring phase b exceed the lower limiting value $P_1$. As the ground resistance increases, the fluid pressure reaches the optimum pressure or the upper limiting value $P_2$. Beginning at boring phase b, boring takes place during the following boring phases c, d, e, f within the pressure range $P_1$ and $P_2$. Because of the feed control according to the invention, this takes place in the boring phase c initially in the direction of a lower feed force, so that the pressure curve at the start of the boring phase d reaches the lower limiting value $P_1$ again, but thereafter always runs between the limiting values $P_1$ and $P_2$ and, over time, approaches more and more closely to the optimum pressure $P_2$ (boring phase f).

Figure 4:
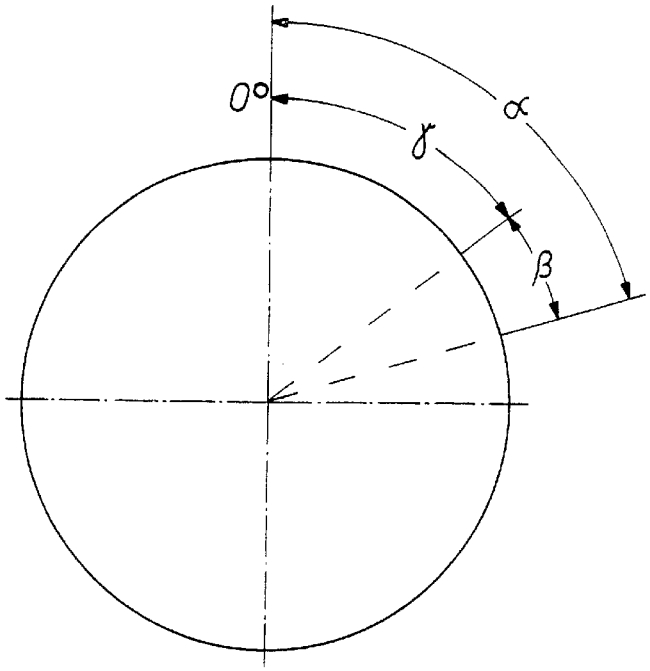
FIG. 4 shows a graphical representation of the individual boring angles which are decisive in the method according to the invention.

From the graph of FIG. 4, starting from a 12 o'clock position as a zero position, the desired path angle (run angle) $\alpha$ and the angle of attack $\gamma$ and also the torsion compensation angle $\beta$ can be seen.

What is claimed is:

1. A method of regulating the feed force of a drilling device having a hydrostatic bore hole motor at the end of a linkage provided with a rotary and a feed drive and an eccentricity for directional boring, wherein the eccentricity during directional boring is set to an angle of attack $$\gamma=\alpha-\beta,$$

$\alpha$ being the path angle of the desired boring direction, $\beta$ being the torsion compensation angle, and $\gamma$ being the angle of attack of the linkage.

2. The method as claimed in claim 1, wherein the torsion compensation angle is determined in accordance with the following formula:

$$\beta=\frac{T\cdot 1}{Ip\cdot G}\cdot\frac{180^\circ}{\pi}+K_1\cdot 1,$$

in which $\beta$=torsion compensation angle

T=torque of the bore hole motor using the motor characteristic curve as a function of the pressure of the drive fluid (bentonite suspension)

l=drilling string length $I_P$=polar surface moment of 2nd order

G=shear modulus of linkage material $K_1$=correction factor for changing pipe cross-sections in the connecting area.

3. A method of regulating the feed movement of a drilling device having a hydrostatic bore hole motor at the end of a linkage provided with a rotary and a feed drive, wherein the feed force of the linkage is regulated as a function of the pressure of the drive fluid for the bore hole motor in accordance with the formula $$p_M=p_P-\Delta P_G\cdot n-\Delta P_M,$$

in which $p_M$=pressure of the bentonite/water suspension at the bore hole motor (drive fluid)

$p_P$=pressure of the bentonite/water suspension at the high pressure pump $\Delta p_G$=pressure drop per linkage section n=number of linkage sections $\Delta p_M$=pressure drop through the machine, etc.

in such a way that the torque of the boring motor remains slightly below the blocking torque.

4. The method as claimed in claim 3, wherein the feed force of the linkage is set in such a way that the fluid pressure at the bore hole motor remains in a predefined range.

5. The method as claimed in claim 4, wherein the fluid pressure at the bore hole motor is kept constant.

* * * * *